US006439745B2

(12) United States Patent
Futami

(10) Patent No.: US 6,439,745 B2
(45) Date of Patent: Aug. 27, 2002

(54) LIGHT COMPOSITION FOR VEHICLE LIGHT

(75) Inventor: Takashi Futami, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/759,961

(22) Filed: Jan. 12, 2001

(30) Foreign Application Priority Data

Jan. 14, 2000 (JP) ..... 2000-006960

(51) Int. Cl.[7] ..... F21V 7/00

(52) U.S. Cl. ..... 362/297; 362/346; 362/298; 362/299; 362/518; 362/539; 362/328

(58) Field of Search ..... 362/297, 346, 362/298, 299, 517, 518, 521, 539, 335, 328, 351, 263

(56) References Cited

U.S. PATENT DOCUMENTS

| | | | | |
|---|---|---|---|---|
| 2,592,075 A | | 4/1952 | Smith | 313/114 |
| 2,647,203 A | | 7/1953 | Smith | 240/41.1 |
| 3,609,340 A | | 9/1971 | Habro | 240/41.1 |
| 4,456,948 A | * | 6/1984 | Brun | 362/298 |
| 5,124,891 A | * | 6/1992 | Blusseau | 362/263 |
| 6,019,492 A | * | 2/2000 | Ikegaya et al. | 362/521 |
| 6,152,589 A | * | 11/2000 | Kawaguchi et al. | 362/518 |
| 6,244,731 B1 | * | 6/2001 | Koito et al. | 362/297 |

* cited by examiner

*Primary Examiner*—Stephen Husar
*Assistant Examiner*—Guiyoung Lee
(74) *Attorney, Agent, or Firm*—Weingarten, Schurgin, Gagnebin & Lebovici LLP

(57) ABSTRACT

A light, wherein the light distribution formation is executed by a first reflection surface made of one of right and left, or upper and lower halves to the optical path of the same direction as the light front direction, a light source disposed near the focus of said first reflection surface and mounted with it's bulb central axis inclined to the first reflection surface side in respect to the light front direction, a second reflection surface made of one of right and left, or upper and lower halves opposed in the closing direction to said first reflection surface in the form of partly open bivalve across this light source and having the focus near said light source, and a third reflection surface disposed outside said first reflection surface and reflecting the light reflected from said second reflection surface to the light front direction.

21 Claims, 5 Drawing Sheets

LIGHT COMPOSITION FOR VEHICLE LIGHT

BACKGROUND OF THE INVENTION

1. Field of the Invention

The present invention concerns a light composition appropriate for vehicle light, and more in detail, has an object to supply a composition further enhancing performances such as light beam availability improvement for a light source of light appropriate for the illumination application such as head lamp.

2. Detailed Description of the Prior Art

Conventional composition examples of this kind of light are shown in FIG. 8 to FIG. 10 and, first, the light 90 shown in FIG. 8 comprises, as basic composition, a rotational parabolic reflector 92 provided with a light source 91 disposed at the focus position, and a lens 93 provided with a lens cut 93*a*, obtains a parallel beam reflected light with said rotational parabolic reflector 92 and obtains a distribution characteristic by conveniently diffusing this reflected light by the lens cut 93*a* of the lens 93.

Second, the light 80 shown in FIG. 9 comprises a combined reflection surface 82 combining a plurality of parabolic cylinders where a parabolic line having a light source 81 as focus appears on the vertical direction cross section in the mounted stage of the light 80 and a straight line appears on the horizontal direction cross section (state as illustrated), and a lens 83 made plain without providing a lens cut, and obtains the light distribution characteristic by said combined reflection surface 82 it-self.

Further, the light 70 shown in FIG. 10 comprises a parabolic reflection surface 72 of rotational parabolic reflection surface, or combined elliptical surface, elliptical free curved surface having a light source 71 as focus, an aspheric lens 73 and a shade provided as necessary, obtains irradiation by enlarging and projecting the light source image converged to and generated at the second focus by the aspheric lens 73, and obtains the shape of required light distribution characteristic, by shielding unnecessary parts with a shade 74. The light 70 of the type adopting this parabolic reflection surface 72 is called "projector type".

However, in the conventional composition mentioned above, the light 90 composition shown in FIG. 8 requires an optically strong lens cut 93*a*, making the lens 93 thickness variation important, resulting in less see-through rate and impossibility of obtaining the exterior excellent in transparency and profoundness feeling that is actually demanded in the market.

On the other hand, in the light 80 shown in FIG. 9, as the lens 83 made plain without providing a lens cut, an exterior excellent in transparent feeling can certainly obtained; however, for instance, the light distribution characteristic right and left breadth is secured hardly, because the light distribution characteristic is formed by the combined reflection surface 82 placed backward and, otherwise, the light distribution characteristic formation is restricted, causing inconveniences.

Moreover, the light 70 shown in FIG. 10 has a large depth, making difficult to install, and at the same time, the aspheric lens 73 outer diameter is limited, and when this light is adopted as headlight, it is hardly recognized by the oncoming car, because its light emitting area is small.

In addition, all of lights 70 to 90 of the conventional composition are largely used and difficult to differentiate from the others and to make their design novel and, moreover, as the light beam availability to the light source is dependent on the depth, for the lights 70 to 90 of the conventional composition, the affectivity falls when there are made thinner to meet with the market demand or others.

SUMMARY OF THE INVENTION

As a concrete means to resolve said conventional problems, the present invention provides a light, wherein the light distribution formation is executed by a first reflection surface made of one of right and left, or upper and lower halves to the optical path of the same direction as the light front direction, a light source disposed near the focus of said first reflection surface and mounted with it 's bulb central axis inclined to the first reflection surface side in respect to the light front direction, a second reflection surface made of one of right and left, or upper and lower halves opposed in the closing direction to said first reflection surface in the form of partly open bivalve across this light source and having the focus near said light source, and a third reflection surface disposed outside said first reflection surface and reflecting the light reflected from said second reflection surface to the light front direction, and a light wherein a fourth reflection surface is disposed at least in one of spaces generated above and under, or light and left of said first reflection surface and second reflection surface.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
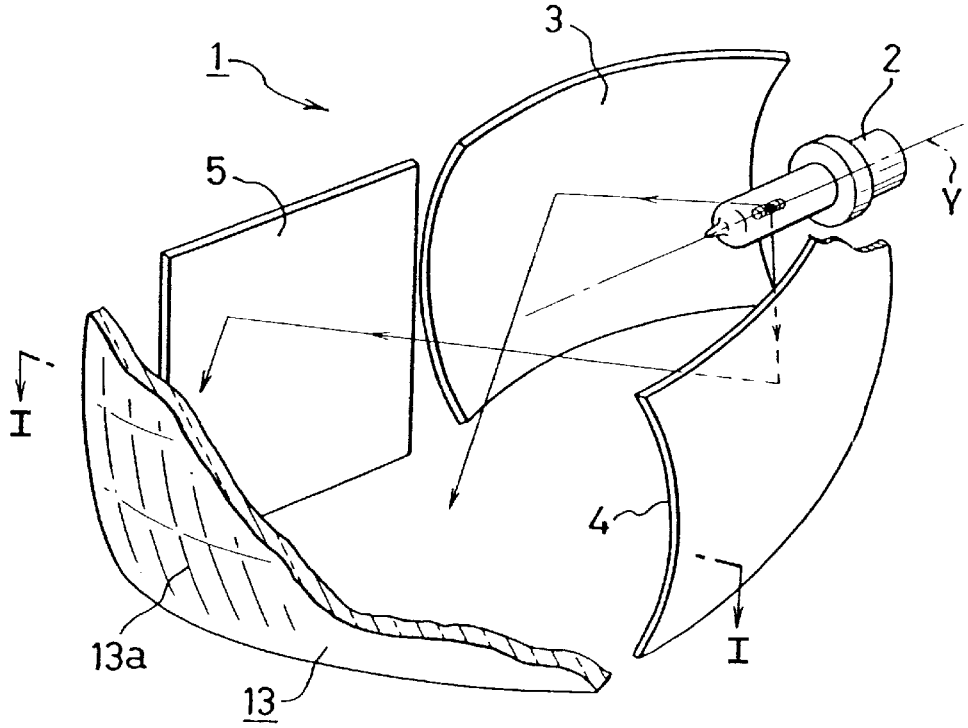
FIG. 1 is a perspective view showing with essential parts a first embodiment of a light of the present invention.
Figure 2:
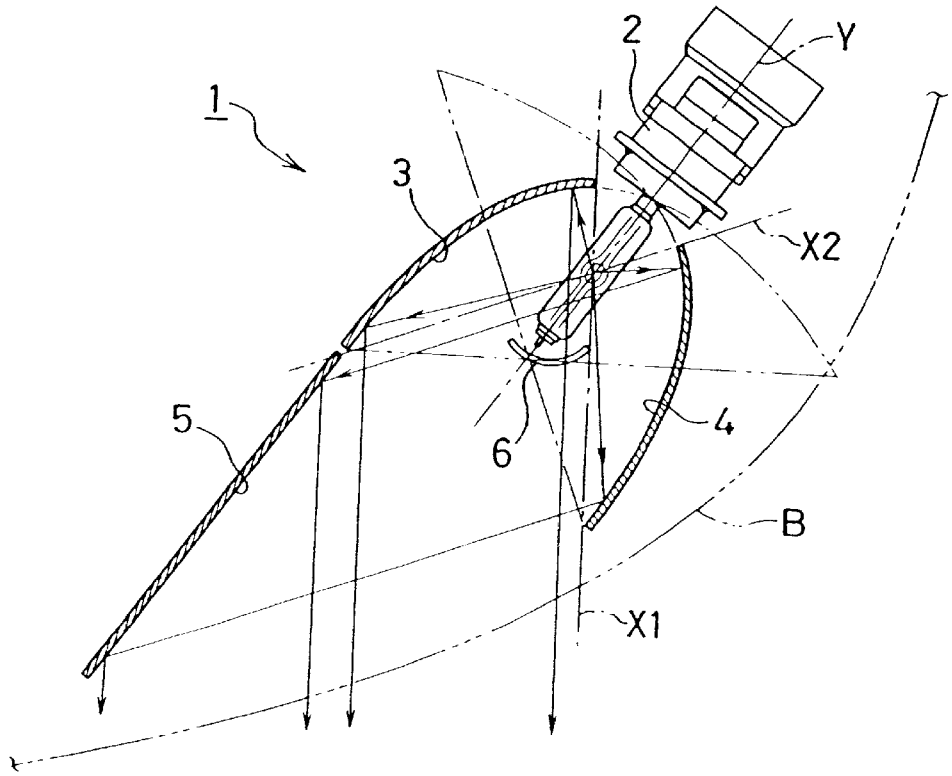
FIG. 2 is a cross-section along the line A—A of FIG. 1.

Next the present invention will be described in detail referring to the embodiments shown in drawings. FIG. 1 and FIG. 2 show a first embodiment of a light 1 of the present invention and, in the first embodiment, the composition of the light 1 for forming the light distribution characteristic, comprises a light source 2 of, for instance, halogen bulb, metal halide lamp or others, a first reflection surface 3, a second reflection surface 4 and a third reflection surface 5.

In this first embodiment, said first reflection surface 3 and second reflection surface 4 are both formed as rotational parabolic surface having the light source 2 substantially as the focus. In the state of art, it is also an old trick to adopt a parabolic reflection surface such as combined surface of parabolic cylinder surface, or parabolic free curved surface, it is also free to select these reflection surface shapes in place of the aforementioned rotational parabolic surface. Besides, a third reflection surface 5, that will be described in detail below, is provided outside said first reflection surface.

For said first reflection surface, as shown in FIG. 2, the optical axis X1(rotational axis of the rotational parabolic surface) is set as the light 1 front direction, thereby, the irradiation direction is set to the light 1 front direction same as the optical axis X1. On the contrary, said second reflection surface 4 has its optical axis X2 inclined toward said third reflection surface 5. Therefore, the second reflection surface 4 slightly closes toward the first reflection surface 3, while the first reflection surface 3 and the second reflection surface 4 form a half-open bivalve at the right half and the left half of the rotational parabolic surface.

Said second reflection surface 4, being formed as rotational parabolic surface as mentioned above, reflects the light radiated from the light source 2 in said optical axis X2 direction, namely, third reflection surface section as parallel light. Said third reflection surface 5 is basically formed as plane mirror, and the light from said second reflection surface 4 is obtained in the light 1 front direction, namely, reflection direction parallel to the reflection direction of the first reflection surface 3. Therefore, a desired light distribution characteristic can be obtained by covering ahead of the first reflection surface 3 and the and providing a publicly known lens 13 with lens cut 13*a*.

As mentioned above, when a combined surface of parabolic cylinder surface, or, parabolic free curved surface allowing to from the light distribution characteristic by the reflection surface itself, a transparent lens can be adopted similarly as the conventional example; however, in the combination of the second reflection surface 4 and the third reflection surface 5, the light distribution characteristic can also be formed by providing a diffusion cut making the said second reflection surface 4, and the third reflection surface 5 side, for instance, parabolic cylinder surface, cylinder surface or the like.

Here, as for said light source 2, as it is obvious in FIG. 2, the second reflection surface 4 being inclined to the first reflection surface 3 side, it is also preferable to incline the light source 2 bulb central axis Y to the same direction, so that both first and second reflection surfaces 3, 4 can be set under the same condition. Therefore, the light source 2 is also inclined in the present invention, and if the inclination angle is set to half of the inclination angle of the second reflection surface 4, both reflection surfaces 3, 4 can be set to the same condition.

Though it has been explained that the first reflection surface 3 and the third reflection surface 5 of the light 1 are arranged in the horizontal direction in FIG. 1, FIG. 2, it can be executed by turning clockwise or counterclockwise by 90 degrees and arranging the first reflection surface 3 and the third reflection surface 5 in the vertical direction, and further, both reflection surfaces 3, 4 can be arranged in any inclination angle. Moreover, a hood shown by symbol 6 in FIG. 2 prevents the direct light from the light source 2 from being radiated outside and dazzling the oncoming car or pedestrians.

In the aforementioned composition, the light 1 of the present invention increases the reflectance factor surrounding the light source 2 by the inclination of the second reflection surface 4 toward the first reflection surface 3, even when a rotational parabolic surface of the same depth as the conventional example is adopted. This increases the light beam availability for the light source 2, and a brighter light 1 can be realized when a light source 2 of the same power consumption is adopted.

In addition, as the second reflection surface 4 is inclined to the first reflection surface 3 side, the irradiation direction (ahead) side of the light source 2 is covered with the second reflection surface 4, and in the covered portion, the direct light from the light source 2 is not radiated outside. Therefore, the hood 6 can be made unnecessary or smaller compared to the conventional example, allowing to cut the cost and improve the exterior.

Moreover, the aforementioned composition enhances the consistency with the vehicle body shape shown by the line B in FIG. 2, and for instance, even for a vehicle of a body shape B with rounded corner, it can be mounted in this corner portion, allowing to use effectively the limited area in the engine room.

Figure 3:
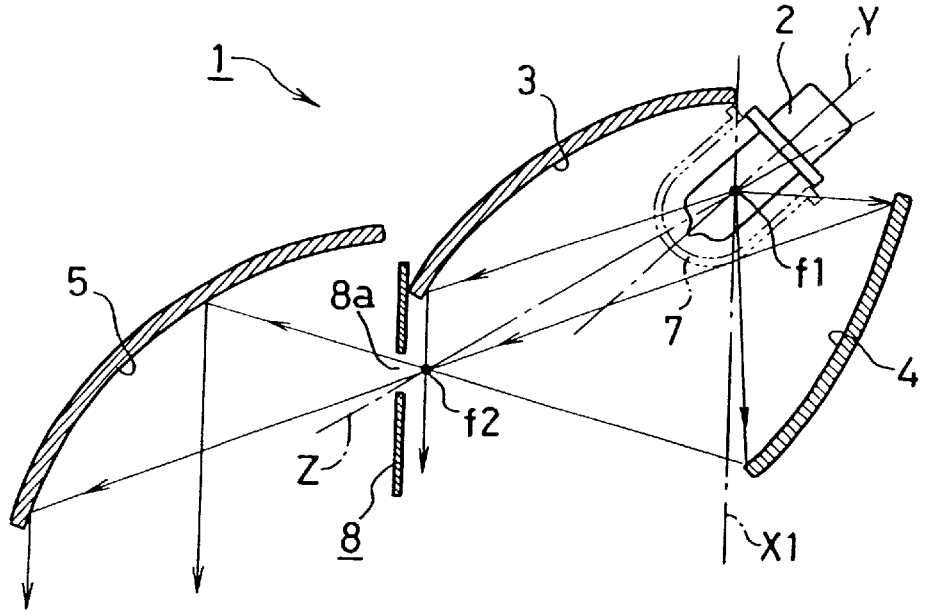
FIG. 3 is similarly a perspective view showing with essential parts a second embodiment of a light of the present invention.

FIG. 3 shows a second embodiment of the present invention, and in this second embodiment also, the first reflection surface is a parabolic reflection surface such as rotational parabolic surface, with its optical axis X1 set as the light 1 front direction, and the light source 2 bulb central axis Y is inclined toward the first reflection surface 3, similarly as the aforementioned first embodiment, so its detailed explanation is omitted herein, except for some parts.

In the second embodiment, the second reflection surface 4 is formed as elliptical reflection surface having a first focus f1 and a second focus f2 such as rotational elliptical surface, and said first focus f1 agrees substantially with the light source 2. There, the long axis Z including said first focus f1 and second focus f2 is inclined toward the first reflection surface, as is said first embodiment, and the reflected light enters the third reflection surface 5 disposed outside the first reflection surface.

At this moment, said second reflection surface 4 makes the second focus f2 to form image of the light source 2 on the long axis Z before attaining the third reflection surface 5, and a shield plate 8 substantially agreeing with this second focus f2 and having an opening section 8*a* passing said light source 2 image is provided, to prevent light from other than the second reflection surface 4 such as direct light from the light source 2 from attaining the third reflection surface 5. Therefore, the opening section 8*a* is dimensioned to for instance 1 mm×5 mm so as to correspond to the light source 2 image formed at the position of the second focus f2.

Moreover, in this second embodiment, said third reflection surface 5 is formed, taking said second focus f2 as focus, as parabolic surface such as rotational parabolic surface having its optical axis in the front direction of the light 1, and directs the light source 2 image formed at the second focus f2 by the second reflection surface 4 to the front direction of the light 1, namely in the irradiation direction, as parallel beam.

Consequently, in the second embodiment also, both lights radiated outside from the first reflection surface 3 and the third reflection surface 5 are basically parallel beams, allowing to form the light distribution characteristic by the means similar to the first embodiment. At this time, in the second embodiment, as the second reflection surface 4 generates conical reflection light converging once the reflected light to the second focus f2, it is easier to prevent the reflected light from attaining the first reflection surface, thus, allowing to incline further the second reflection surface 4 toward the first reflection surface 3, and to increase further the effectiveness.

In FIG. 3, a colored cap covering the light source 2 is shown by the symbol 7, this light 1 is a fog lamp, and when a prescribed color, such as amber, is required for the light color, the light radiated outside from the light 1 can be colored in the prescribed color by mounting this colored cap 7. This colored cap 7 can be fitted not only to the second embodiment, but also to any of embodiments.

Figure 4:
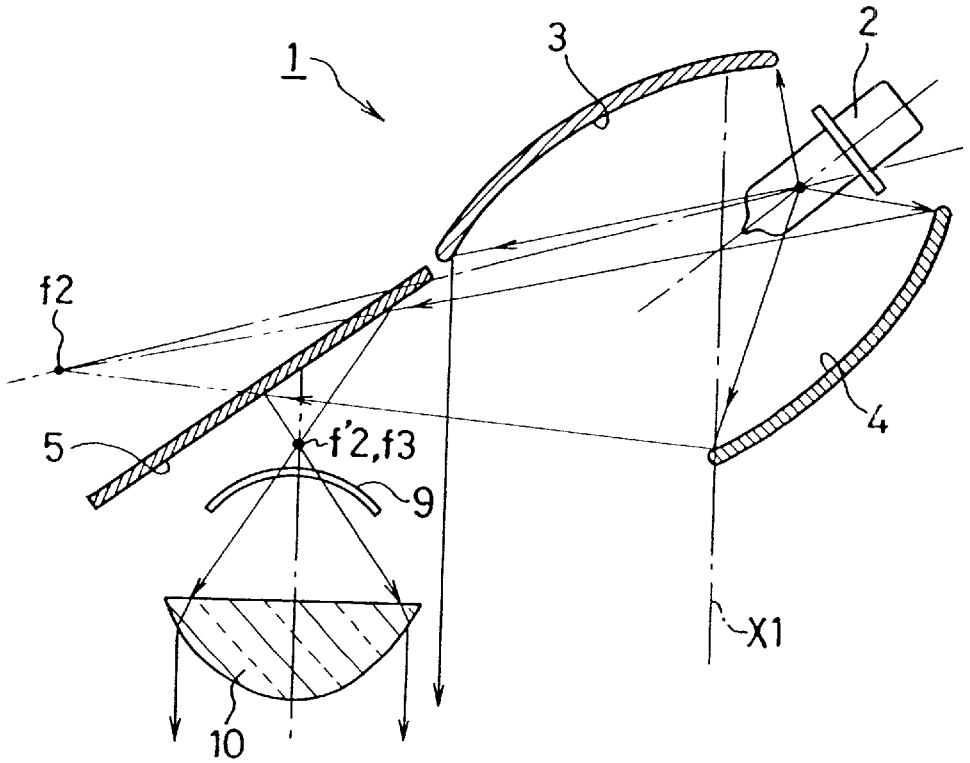
FIG. 4 is similarly a perspective view showing with essential parts a third embodiment of a light of the present invention.

FIG. 4 shows a third embodiment of the present invention, and the composition of the first reflection surface 3 and the second reflection surface 4 are substantially similar to said second embodiment, except that, while the second reflection surface 4 has its second focus f2 at the front side of the third reflection surface 5 in the aforementioned second embodiment, the second focus f2 is positioned at the back side of the third reflection surface 5 in this third embodiment, to reflect in the light 1 front direction by the third reflection surface 5 which is a plane mirror in a state before image formation.

Figure 10:
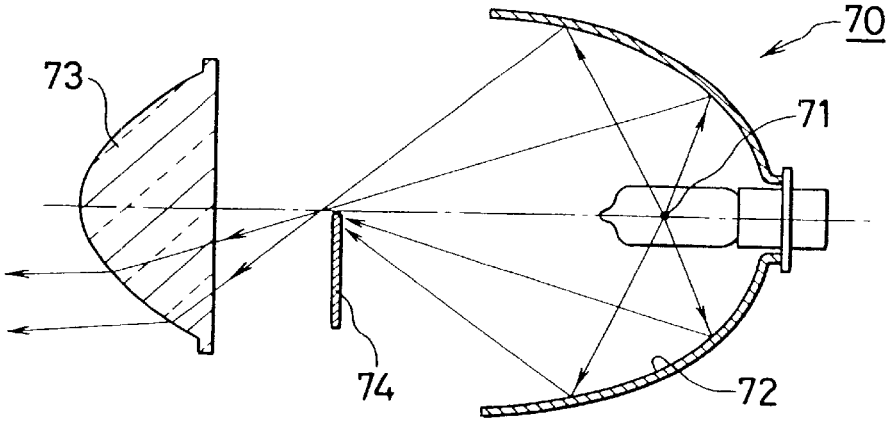
FIG. 10 is a cross section showing still another conventional example.

In addition, in this third embodiment, a shutter 9 correcting the light distribution characteristic shape in provided near the second focus f2 generated by the reflection from said third reflection surface 5, and an aspheric convex lens 10 having a focus f3 near said second focus f2, and such composition allows the light from the second reflection surface 4 through the third reflection surface 5 to form the light distribution characteristic by the same function as the so-called projector type light of the conventional example (refer to FIG. 10 of the conventional example).

Figure 5:
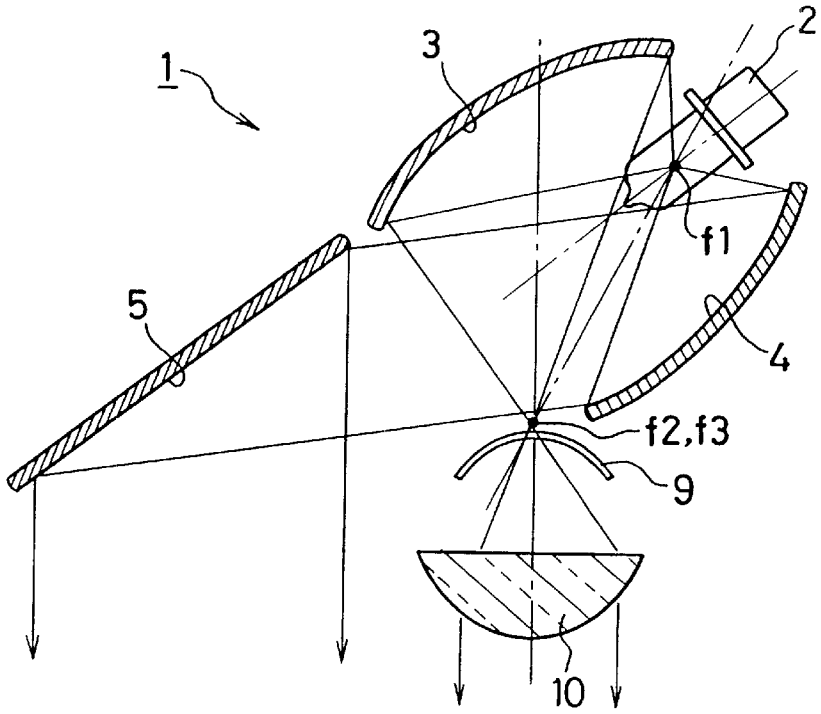
FIG. 5 is similarly a perspective view showing with essential parts a fourth embodiment of a light of the present invention.

FIG. 5 is a fourth embodiment of the present invention, wherein the composition of the first reflection surface and the second reflection surface of the aforementioned third embodiment is exchanged, namely, the first reflection surface 3 is formed as elliptical reflection surface having the first focus f1 near the light source 2 such as rotational elliptical surface, the second reflection surface 4 is formed as parabolic surface such as rotational parabolic surface having its focus near the light source similarly to the first embodiment, and the third reflection surface 5 is formed as plane mirror.

Then, the second focus f2 of the first reflection surface 3 is arranged in the vicinity of the front of this first reflection surface 3, a shutter9 is provide in the vicinity of this second focus f2, and an aspheric convex lens 10 having its focus f3 near said second focus f2 is provided. Such composition of this fourth embodiment allows the first reflection surface 3 to form the light distribution characteristic by the same function as the projector type, contrary to the third embodiment. On the other hand, the light reflected from the second reflection surface 4 through the third reflection surface 5 becomes the same state as the aforementioned first embodiment.

Figure 6:
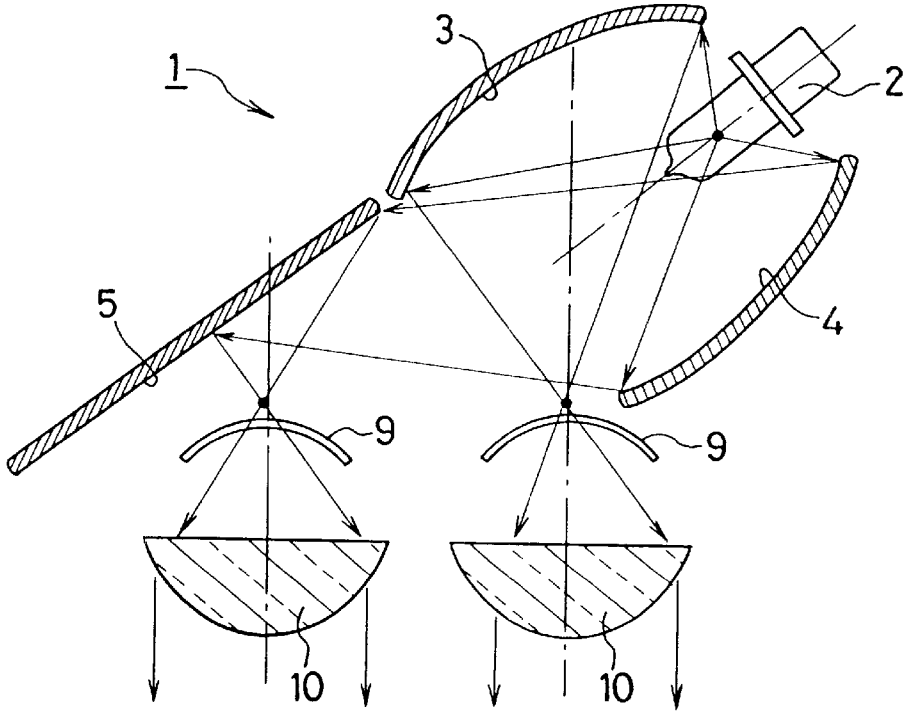
FIG. 6 is similarly a perspective view showing with essential parts a fifth embodiment of a light of the present invention.

FIG. 6 shows a fifth embodiment of the present invention, combining the composition of the first reflection surface 3 of said fourth embodiment and the composition of the second reflection surface 4 and the third reflection surface 5 of the third embodiment, thus allowing both the light reflected from the first reflection surface and the light reflected from the second reflection surface 4 through the third reflection surface 5 to form the light distribution characteristic by the same function as the projector type by the shutter 9 and the aspheric convex lens 10.

Though not illustrated, it is also possible to compose a light by combining the combination of the first reflection surface 3 of the aforementioned fourth embodiment and the composition of the second reflection surface 4 and the third reflection surface 5 of the second embodiment (sixth embodiment), and in this case, the light 1 forms the light distribution characteristic by the shutter 9 and the aspheric convex lens 10 at the first reflection surface 3 side, and at the second reflection surface 4, forms the light distribution characteristic by a lens (not shown) covering the front or by a diffusion cut provided on the third reflection surface 5.

Figure 7:
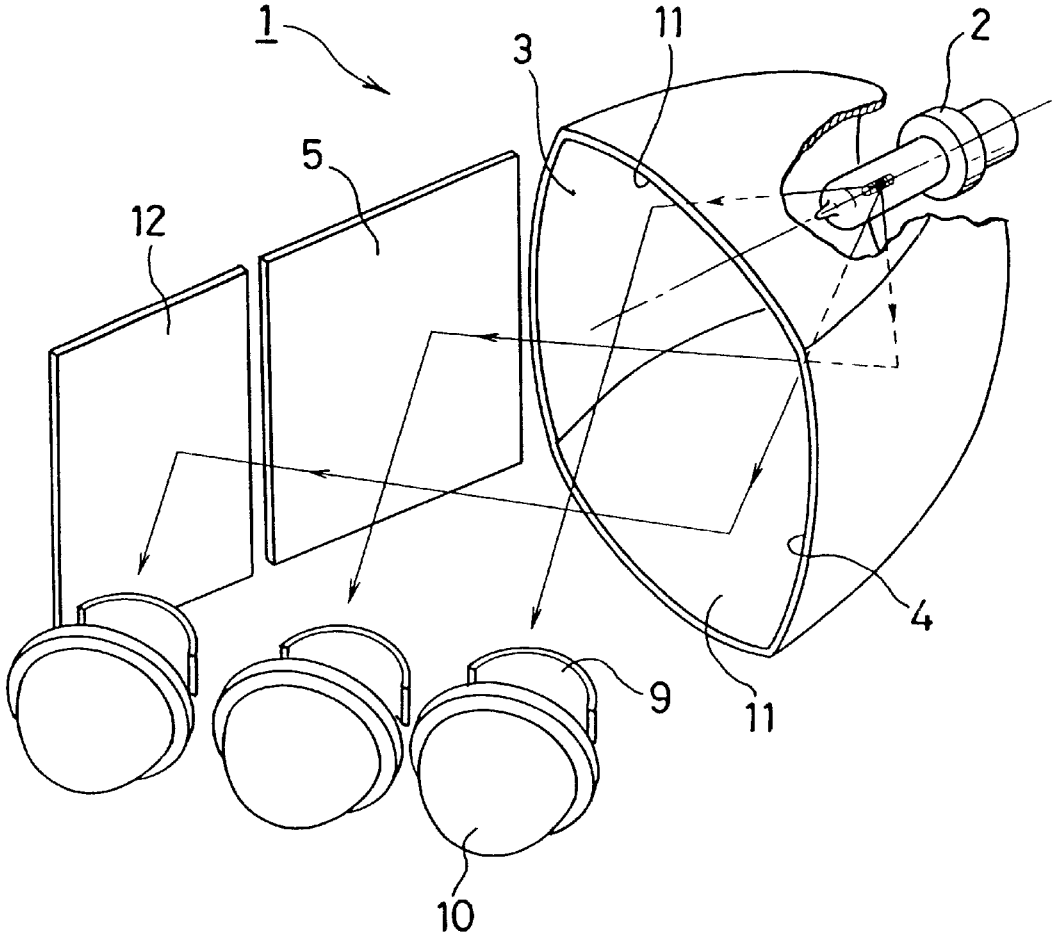
FIG. 7 is similarly a perspective view showing with essential parts a seventh embodiment of a light of the present invention.
Figure 8:
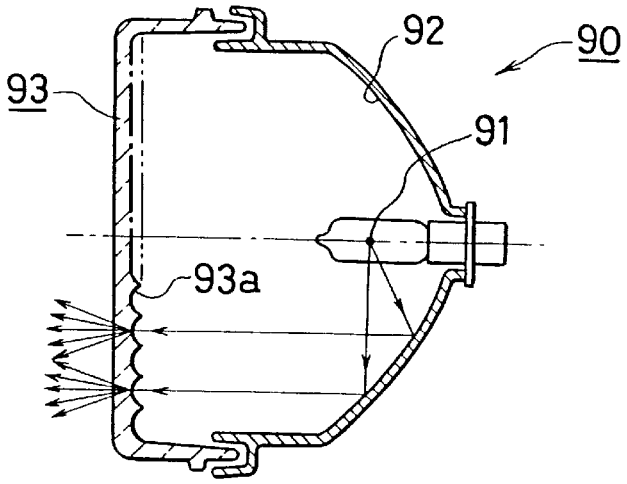
FIG. 8 is a cross section showing a conventional example.
Figure 9:
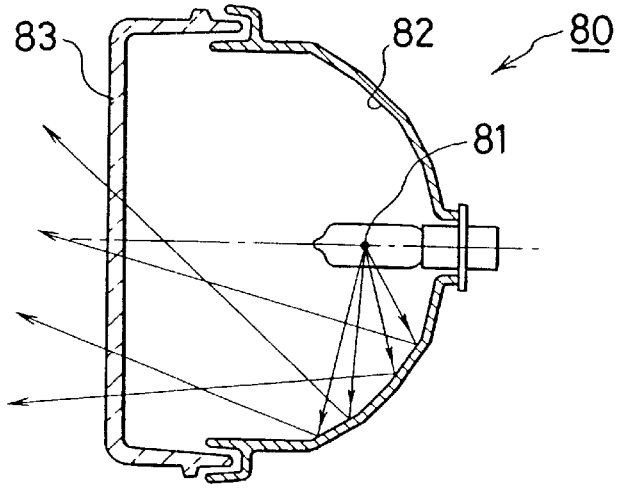
FIG. 9 is a cross section showing another conventional example.

FIG. 7 shows a seventh embodiment; though every embodiment mentioned above concerns the first reflection surface 3, the second reflection surface 4 and the third reflection surface 5, in this seventh embodiment, a fourth reflection surface 11 is disposed in the gap between the first reflection surface 3 and the second reflection surface 4, profiting that they are combined in bivalve form. The seventh embodiment can be implemented combining with any one of the aforementioned first to sixth embodiments.

At this time, when the light 1 has a composition to arrange the first reflection surface 3 and the third reflection surface 5 in the horizontal direction, said gap is produced at upper and lower two points, and in a composition arranging the first reflection surface 3 and the third reflection surface 5 in the vertical direction, the gap is produced at right and left two points; however, in the present invention, the fourth reflection surface 11 may be provided at both of said upper and lower (or right and left) two points, or at either one of them.

Also, said fourth reflection surface 11 may be composed as parabolic surface having its focus neat the light source 2 as the first reflection surface 3 of the aforementioned first embodiment to radiate the reflected light outside directly from the light 1, or as elliptical surface having its first focus f1 neat the light source 2 as the second reflection surface 4 of the second to third embodiments, and if this elliptical surface is adopted, a fifth reflection surface 12 is further provided outside 3 the third reflection surface 5.

When this elliptical surface is adopted, the second focus f2 of the fourth reflection surface 11 may be in front of the fifth reflection surface 12 as in the second embodiment, and in this case, the fifth reflection surface 12 is formed as a parabolic surface having the light source 2 as its focus, and a shield plate 8 is provided at the position of the second focus f2 to form the light distribution characteristic. Otherwise, it may be positioned at the back side of the fifth reflection surface 12, and in this case, the shutter 9 and the aspheric convex lens 10 are disposed (as shown in FIG. 7) to form the light distribution characteristic.

In the present invention, three series exist to emit light outside the light 1 from a single light source 2, namely first reflection surface 3, second reflection surface 4 and third reflection surface 5, and, fourth reflection surface 11 and fifth reflection surface 12; consequently, in the series of second reflection surface 4, for example, it is possible to make only this series colored light, by coloring either one of second reflection surface 4 and third reflection surface 5.

At this time, if the aforementioned second reflection surface 4 series uses a shield plate, the same function can be obtained by attaching a coloring filter to the opening portion 8*a* of the shield plate 8, and if an aspheric convex lens 10 is used, the same function can be obtained by coloring this aspheric convex lens 10.

Moreover, if both faces of the shield plate 8 other than the opening 8*a* is colored, the colored color is reflected by respective reflection surface when the light 1 is not turned on, and it becomes possible to appear the whole light 1, for instance, in the vehicle body color, when it is not turned on, for instance, during the day time.

As described hereinabove, a light according to the present invention, wherein the light distribution formation is executed by a first reflection surface made of one of right and left, or upper and lower halves to the optical path of the same direction as the light front direction, a light source disposed near the focus of said first reflection surface and mounted with it bulb central axis inclined to the first reflection surface side in respect to the light front direction, a second reflection surface made of one of right and left, or upper and lower halves opposed in the closing direction to said first reflection surface in the form of partly open bivalve across this light source and having the focus near said light source, and a third reflection surface disposed outside said first reflection surface and reflecting the light reflected from said second reflection surface to the light front direction, and a light wherein a fourth reflection surface is disposed at least in one of spaces generated above and under, or light and left of said first reflection surface and second reflection surface, allow, first, to realize a brighter light with a light source of the same power consumption, by improving the light beam availability of the light source, and bring an extremely remarkable result in the performance improvement of this kind of light.

Second, by the aforementioned composition, the second reflection surface substantially covers the light source, and the hood preventing conventionally the direct light of the light source from being radiated outside and dazzling can be made unnecessary or smaller and, in this respect too, the light beam availability of the light source is improved, bringing an excellent result in the cost reduction. Besides, as the light source is made invisible, a new design can be conceived, bringing an excellent result in the esthetic improvement.

Moreover, the aforementioned composition allows to shape the light in a way appropriate to be fitted to the vehicle corner, reduce the occupation area in the engine room, and bring also an excellent result permitting to use effectively a limited capacity.

While the present preferred embodiment of the present invention has been shown and described, it will be understood that the present invention is not limited thereto, and that various changes and modifications may be by those skilled in the art without departing from the scope of the invention as set forth in the appended claims.

What is claimed is:

1. A light, wherein the light distribution formation is executed by a first reflection surface made of one of right and left, or upper and lower halves to the optical path of the same direction as the light front direction, a light source disposed near the focus of said first reflection surface and mounted with it's bulb central axis inclined to the first reflection surface side in respect to the light front direction, a second reflection surface made of one of right and left, or upper and lower halves opposed in the closing direction to said first reflection surface in the form of partly open bivalve across this light source and having the focus near said light source, and a third reflection surface disposed outside said first reflection surface and reflecting the light reflected from said second reflection surface to the light front direction.

2. The light of claim 1, wherein said first reflection surface is one of rotational parabolic surface, parabolic cylinder surface, free curved surface, or a combined surface of any one of three surfaces generating the reflected light in the light front direction, and said second reflection surface is one of rotational parabolic surface, parabolic cylinder surface, free curved surface, or a combined surface of any one of three surfaces generating the reflected light in said the third reflection surface direction, and said third reflection surface is a combined surface of plane or cylinder surface generating the reflected light of said the second reflection surface in the light front direction.

3. The light of claim 1, wherein said first reflection surface is one of rotational parabolic surface, parabolic cylinder surface, free curved surface, or a combined surface of any one of three surfaces generating the reflected light in the light front direction, said second reflection surface is a rotational parabolic surface having a first focus near said light source and its long axis including a second focus is inclined toward said first reflection surface, a shield plate having an opening portion equal or less than 10 mm in length and width is provided near said second focus of this second reflection surface, and said third reflection surface is one of rotational parabolic surface, parabolic cylinder surface, free curved surface, or a combined surface of any one of three surfaces having its focus near the opening section of said shield plate and generating the reflected light in the light front direction.

4. The light of claim 1, wherein said first reflection surface is one of rotational elliptical surface, elliptical free curved surface, oblong elliptical surface, or an assembly surface of any one of three surfaces having a first focus near said light source and a second focus in the light front direction of this first reflection surface, said second reflection surface is one of rotational parabolic surface, parabolic cylinder surface, free curved surface, or a combined surface of any one of three surfaces generating the reflected light in the third reflection surface direction, said third reflection surface is a combined surface of plane or cylinder surface reflecting the reflected light from said second reflection surface in the light front direction, and an aspheric convex lens having its focus near the second focus and its optical axis in the light front direction, corresponding to the second focus of said first reflection surface.

5. The light of claim 4, wherein a shutter is provided near said second focus to form the light distribution characteristic.

6. The light of claim 1, wherein said first reflection surface is one of rotational parabolic surface, parabolic cylinder surface, free curved surface, or a combined surface of any one of three surfaces generating the reflected light in the light front direction, said second reflection surface is one of rotational elliptical surface, elliptical free curved surface, oblong elliptical surface, or an assembly surface of any one of three surfaces having a first focus near said light source generating the reflected light in the third reflection surface direction, said third reflection surface is a combined surface of plane or cylinder surface reflecting the reflected light from said second reflection surface in the light front direction before forming an image at the second focus, and an aspheric convex lens having its focus near the second focus and its optical axis in the light front direction, corresponding to the second focus of said second reflection surface forming the image after reflecting on said third reflection surface.

7. The light of claim 6, wherein a shutter is provided near said second focus to form the light distribution characteristic.

8. The light of claim 1, wherein said first reflection surface and second reflection surface are one of rotational elliptical surface, elliptical free curved surface, oblong elliptical surface, or an assembly surface of any one of three surfaces having a first focus near said light source, said first reflection surface has a second focus in the light front direction of this first reflection surface, said second reflection surface generating the reflected light in the third reflection surface direction, said third reflection surface is a combined surface of plane or cylinder surface reflecting the reflected light from said second reflection surface in the light front direction before forming an image at the second focus, and an aspheric convex lens having its focus near the second focus and its optical axis in the light front direction, corresponding to the second focus of said first reflection surface and the second focus of said second reflection surface forming the image after reflecting on said third reflection surface.

9. The light of claim 8, wherein a shutter is provided near at least one of said second focus of said first reflection surface or second reflection surface to form the light distribution characteristic.

10. The light of claim 1, wherein a fourth reflection surface is provided in a gap generated at least one of above and under, or right and left of said first reflection surface or second reflection surface.

11. The light of claim 10 wherein said fourth reflection surface is one of rotational parabolic surface, parabolic cylinder surface, free curved surface, or a combined surface of any one of three surfaces.

12. The light of claim 10, wherein said fourth reflection surface is formed as a rotational parabolic surface having a first focus near said light source and its long axis including a second focus is inclined toward said first reflection surface, a second shield plate having an opening portion equal or less than 10 mm in length and width is provided near said second focus of this fourth reflection surface, and a fifth reflection surface formed as one of rotational parabolic surface, parabolic cylinder surface, free curved surface, or a combined surface of any one of three surfaces having its focus near the opening section of said second shield plate and generating the reflected light in the light front direction is provided.

13. The light of claim 10, wherein said fourth reflection surface is one of rotational elliptical surface, elliptical free curved surface, oblong elliptical surface, or an assembly surface of any one of three surfaces having a first focus near said light source, a fifth reflection surface is provided outside said third reflection surface to reflect the reflected light from said fourth reflection surface in the light front direction, and an aspheric convex lens having its focus near the second focus and its optical axis in the light front direction, corresponding to the second focus of said fourth reflection surface forming the image after reflecting on said fifth reflection surface.

14. The light of claim 1, wherein at least said first to fifth reflection surfaces has respective reflection surface provided with diffusion cut all over the surface or a part thereof.

15. The light of claim 1, wherein the light source is provided with a colored cap, or whole the light is provided with a colored lens.

16. The light of claim 1, wherein at least a part of light component forming the light distribution characteristic of said reflection surface, shield plate, shutter and aspheric convex lens and parts other than said light component is colored.

17. The light of claim 8, wherein a fourth reflection surface is provided in a gap generated at least one of above and under, or right and left of said first reflection surface or second reflection surface.

18. The light of claim 12 wherein said fourth reflection surface is one of combined surface of rotational parabolic surface, parabolic cylinder surface, or, parabolic free curved surface.

19. The light of claim 17, wherein said fourth reflection surface is formed as a rotational parabolic surface having a first focus near said light source and its long axis including a second focus is inclined toward said first reflection surface, a second shield plate having an opening portion equal or less than 10 mm in length and width is provided near said second focus of this fourth reflection surface, and a fifth reflection surface formed as a combined surface of rotational parabolic surface, parabolic cylinder surface, or, parabolic free curved surface having its focus near the opening section of said second shield plate and generating the reflected light in the light front direction is provided.

20. The light of claim 17, wherein said fourth reflection surface is an assembly surface of rotational elliptical surface, elliptical free curved surface, or, oblong elliptical surface having a first focus near said light source, a fifth reflection surface is provided outside said third reflection surface to reflect the reflected light from said fourth reflection surface in the light front direction, and an aspheric convex lens having its focus near the second focus and its optical axis in the light front direction, corresponding to the second focus of said fourth reflection surface forming the image after reflecting on said fifth reflection surface.

21. The light of claim 13, wherein:

at least one of said first to fifth reflection surfaces has respective reflection surface provided with diffusion cut all over the surface or a part thereof;

the light source is provided with a colored cap, or whole the light is provided with a colored lens; and at least a part of light component forming the light distribution characteristic of said reflection surface, shield plate, shutter and aspheric convex lens and parts other than said light component is colored.

* * * * *

UNITED STATES PATENT AND TRADEMARK OFFICE

CERTIFICATE OF CORRECTION

PATENT NO. : 6,439,745 B2
DATED : August 27, 2002
INVENTOR(S) : Takashi Futami et al.

It is certified that error appears in the above-identified patent and that said Letters Patent is hereby corrected as shown below:

Column 9,
Line 46, “least said” should read -- least one of said --.

Signed and Sealed this

Eighth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,439,745 B2
APPLICATION NO. : 09/759961
DATED : August 27, 2002
INVENTOR(S) : Takashi Futami et al.

It is certified that error appears in the above-identified patent and that said Letters Patent is hereby corrected as shown below:

Column 2, line 25, “light” should read --right--;

Column 2, line 35, “A-A” should read --I-I--;

Column 3, line 32, “and the and providing” should read --and providing--;

Column 6, line 29, “neat” should read --near--;

Column 6, line 33, “neat” should read --near--; and

Column 7, line 17, “light” should read --right--.

Signed and Sealed this

Fourth Day of September, 2007

JON W. DUDAS
*Director of the United States Patent and Trademark Office*